US011527195B2

(12) United States Patent
Yeh et al.

(10) Patent No.: US 11,527,195 B2
(45) Date of Patent: Dec. 13, 2022

(54) DISPLAY CONTROL SYSTEM AND RELATED METHOD OF SIGNAL TRANSMISSION

(71) Applicant: NOVATEK Microelectronics Corp., Hsin-Chu (TW)

(72) Inventors: Che-Wei Yeh, Hsinchu (TW); Keko-Chun Liang, Hsinchu (TW); Yu-Hsiang Wang, Hsinchu (TW); Yong-Ren Fang, Kaohsiung (TW); Yi-Chuan Liu, Hsinchu County (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 70 days.

(21) Appl. No.: 17/238,179

(22) Filed: Apr. 22, 2021

(65) Prior Publication Data

US 2022/0343833 A1 Oct. 27, 2022

(51) Int. Cl.
*G09G 3/04* (2006.01)
*G09G 3/32* (2016.01)

(52) U.S. Cl.
CPC ..... *G09G 3/32* (2013.01); *G09G 2310/08* (2013.01); *G09G 2330/028* (2013.01); *G09G 2370/14* (2013.01)

(58) Field of Classification Search
CPC ..... G09G 3/06–12; G09G 3/16–18; G09G 3/22–3691; G09G 2330/028; G09G 2310/08; G09G 2370/14
See application file for complete search history.

(56) References Cited

U.S. PATENT DOCUMENTS

2010/0141300 A1* 6/2010 Hwang ..... H05B 45/14 326/82
2010/0141672 A1* 6/2010 Kang ..... H05B 47/10 345/589
2013/0321254 A1* 12/2013 Kim ..... G09G 3/36 345/102

* cited by examiner

*Primary Examiner* — Sanghyuk Park
(74) *Attorney, Agent, or Firm* — Winston Hsu

(57) ABSTRACT

A display control system includes a plurality of driver circuits connected in series. A driver circuit among the plurality of driver circuits includes a receiver, a duty cycle correction circuit and a transmitter. The receiver is configured to receive a first signal from a previous driver circuit among the plurality of driver circuits. The duty cycle correction circuit, coupled to the receiver, is configured to adjust a duty cycle of the first signal to generate a second signal. The transmitter, coupled to the duty cycle correction circuit, is configured to transmit the second signal to a next driver circuit among the plurality of driver circuits.

22 Claims, 15 Drawing Sheets

DISPLAY CONTROL SYSTEM AND RELATED METHOD OF SIGNAL TRANSMISSION

BACKGROUND OF THE INVENTION

1. Field of the Invention

The present invention relates to a display control system, and more particularly, to a display control system for controlling a light-emitting diode (LED) display panel.

2. Description of the Prior Art

Conventionally, the driver circuits for a light-emitting diode (LED) display panel are usually connected with a serial peripheral interface (SPI), where a low speed clock signal is sent to each driver circuit to perform display driving control and synchronization. The low speed clock has the advantages of lower channel loss and higher signal integrity when transmitted on the traces of the printed circuit board (PCB) between the driver circuits. After a driver circuit receives the low speed clock signal, a phase-locked loop (PLL) of the driver circuit may convert the low speed clock signal into a high speed clock signal for the usage of high resolution display operation.

The PLL, which is usually composed of a phase detector, charge pump, loop filter, voltage-controlled oscillator (VCO) and frequency divider, may have a complex structure, require high power consumption and occupy large circuit area. In order to avoid the usage of PLL, a global high speed clock may be applied, to be sent to each driver circuit through the traces of the PCB. The high speed clock signal may be in a frequency of several hundreds of megahertz (MHz), as faster than the frequency of the low speed SPI clock which is usually lower than 20 MHz. However, the high speed clock may be confronted with higher distortion when transmitted between the driver circuits. That is, the non-ideal channel characteristics of the PCB such as reflection, loss and coupling will limit the frequency of the transmitted signals.

Thus, there is a need to provide a novel transmission scheme, allowing the transmission of a high speed clock signal between the driver circuits to be feasible.

SUMMARY OF THE INVENTION

It is therefore an objective of the present invention to provide a display control system consisting of a plurality of driver circuits between which a high speed clock signal may be transmitted successfully.

An embodiment of the present invention discloses a display control system, which comprises a plurality of driver circuits connected in series. A driver circuit among the plurality of driver circuits comprises a receiver, a duty cycle correction circuit and a transmitter. The receiver is configured to receive a first signal from a previous driver circuit among the plurality of driver circuits. The duty cycle correction circuit, coupled to the receiver, is configured to adjust a duty cycle of the first signal to generate a second signal. The transmitter, coupled to the duty cycle correction circuit, is configured to transmit the second signal to a next driver circuit among the plurality of driver circuits.

Another embodiment of the present invention discloses a method of signal transmission fora driver circuit among a plurality of driver circuits connected in series. The method comprises steps of: receiving a first signal from a previous driver circuit among the plurality of driver circuits; adjusting a duty cycle of the first signal to generate a second signal; and transmitting the second signal to a next driver circuit among the plurality of driver circuits.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
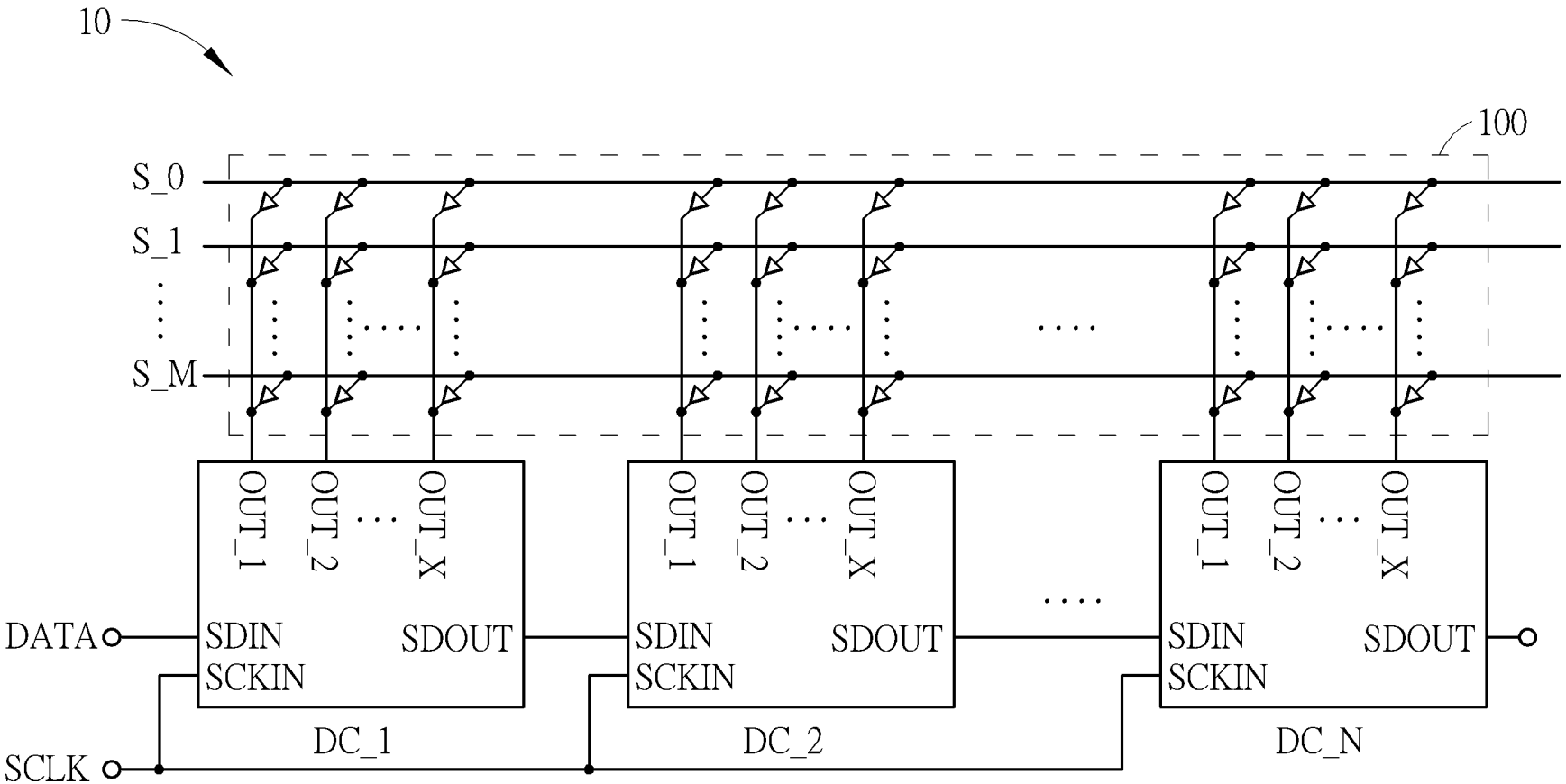
FIG. 1 is a schematic diagram of a general display control system for a display panel.

Please refer to FIG. 1, which is a schematic diagram of a general display control system 10 for a display panel 100 such as a light-emitting diode (LED) display panel. The display control system 10 includes a plurality of driver circuits DC_1-DC_N connected in series. Each of the driver circuits DC_1-DC_N includes a data input terminal SDIN, a data output terminal SDOUT, a clock input terminal SCKIN, and multiple driving output terminals OUT_1-OUT_X. The display panel 100 may display images under control and driving of the driver circuits DC_1-DC_N. Each driver circuit DC_1-DC_N is configured to control the display operations on partial pixels of the display panel 100 by outputting display driving voltages through the driving output terminals OUT_1-OUT_X. The display panel 100 may be composed of an LED array, wherein each column of LEDs are coupled to one of the driver circuits DC_1-DC_N, and each row of LEDs are driven by one of the scan lines S_0-S_M.

As shown in FIG. 1, the display data may be sequentially forwarded between the driver circuits DC_1-DC_N. For example, a video source may send display data to the driver circuit DC_1, the driver circuit DC_1 may forward the received display data to the driver circuit DC_2 in the next stage, the driver circuit DC_2 may forward the received display data to the driver circuit DC_3 in the next stage, . . . and the driver circuit DC_(N−1) may forward the received display data to the driver circuit DC_N in the final stage. In this manner, the display data may be forwarded to all of the driver circuits DC_1-DC_N. After all driver circuits DC_1-DC_N receive their display data, they may simultaneously output the driving voltages corresponding to the display data to the display panel 100. The display output operations may be synchronized with a clock signal SCLK, which may be transmitted from the video source or main controller (not illustrated). In an example, each driver circuit DC_1-DC_N may be an integrated circuit (IC) included in a chip implemented on a circuit board such as a printed circuit board (PCB), and the video source or main controller may be coupled to each driver circuit DC_1-DC_N through wire connections on the PCB.

Figure 2A:
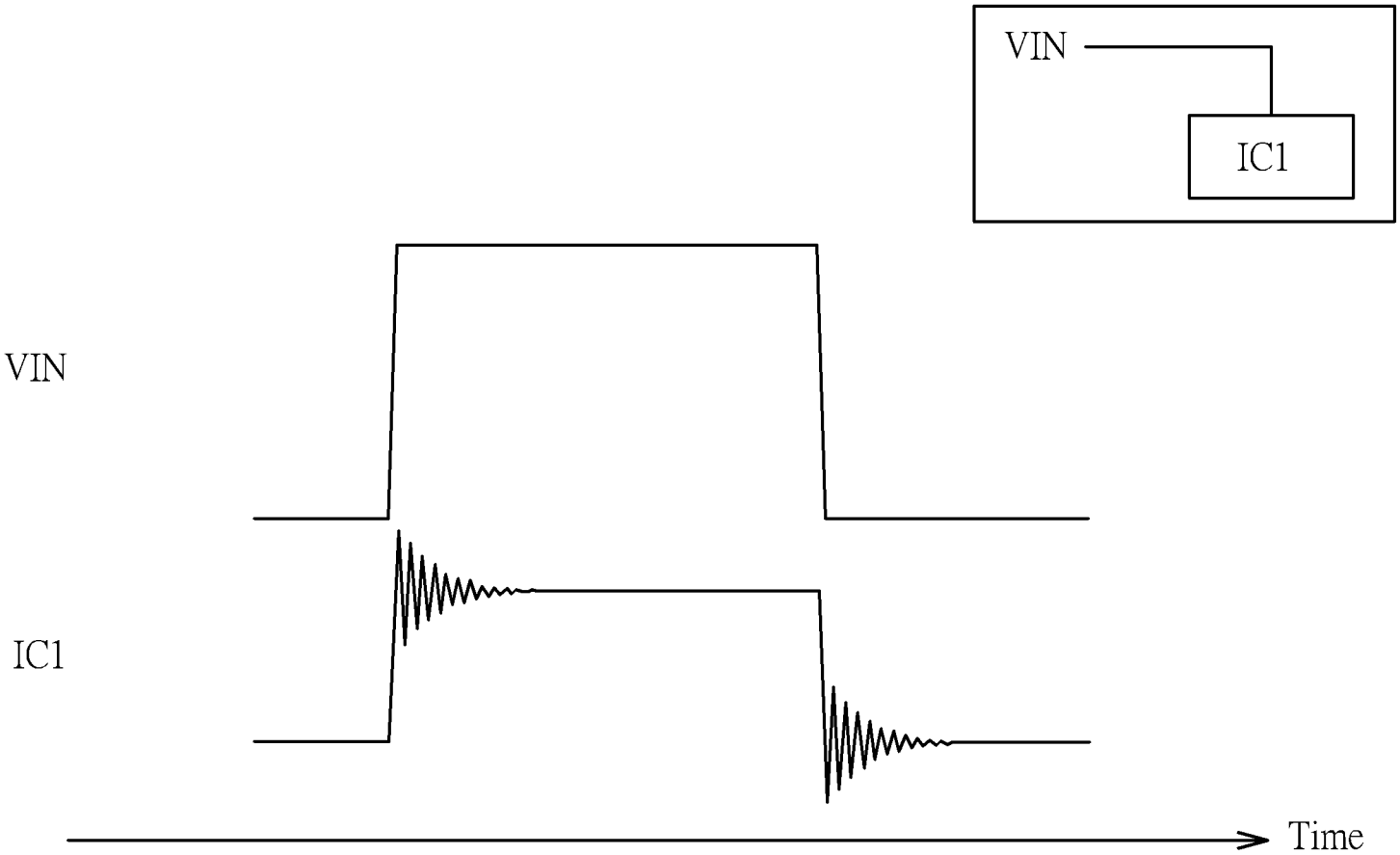
FIGS. 2A and 2B illustrate the influences of terminal numbers on the signal integrity.
Figure 2B:
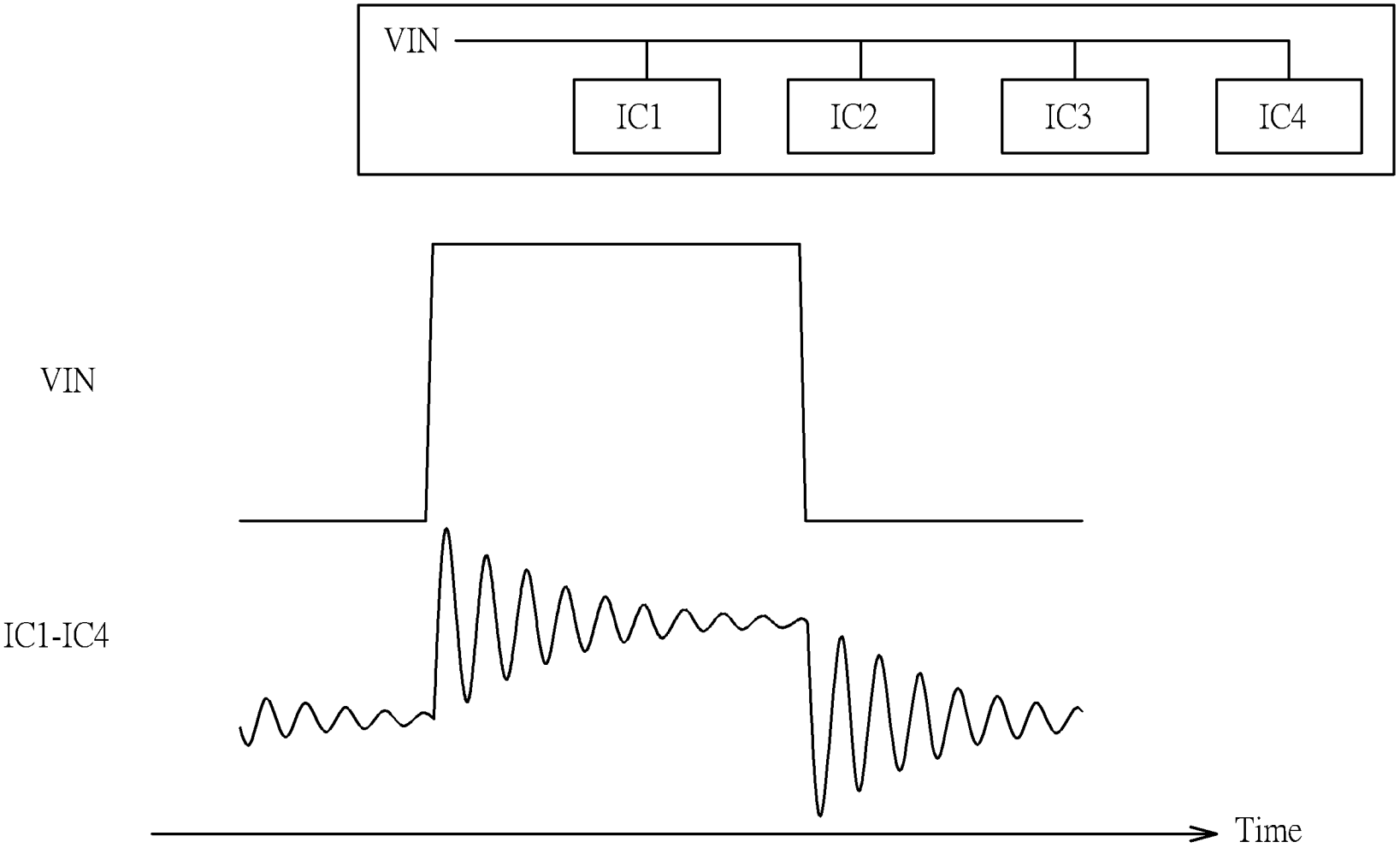

In general, the clock signal SCLK may be a low speed global clock signal transmitted in the serial peripheral interface (SPI). As shown in FIG. 1, the trace for transmitting the clock signal SCLK is connected in form of the multi-drop bus, which is connected to multiple driver circuits and includes a great number of terminals. Under the trend of large-scale display panel, the number of driver circuits in the display control system may be increased, which in turn increases the terminals of the PCB trace. Each terminal has discontinuity of impedance and thus generates reflection that may influence the signal integrity. The increasing numbers of terminals result in a significant reduction of signal integrity, especially for high speed signals. Please refer to FIGS. 2A and 2B, which illustrate the influences of terminal numbers on the signal integrity. FIG. 2A shows a circuit structure having a signal input terminal VIN connected with one driver circuit IC1. If an ideal clock signal is transmitted from the signal input terminal VIN to the driver circuit IC1, the clock signal received by the driver circuit IC1 may still be recognizable. FIG. 2B shows a circuit structure where the signal input terminal VIN is connected with four driver circuits IC1-IC4. In this case, with the same clock signal outputted from the signal input terminal VIN with the same driving capability, the clock signal received by any of the driver circuits IC1-IC4 may include severe oscillation and thus may not be easily recognized.

In addition, the connections of the multi-drop bus require that the trace goes through a longer distance to reach every driver circuit. The greater the number of driver circuits receiving the clock signal, the longer the trace for forwarding the clock signal. The longer trace is usually accompanied by larger RC loading. More specifically, the magnitude of resistive loading is directly proportional to the length of signal propagation; meanwhile, the longer trace may easily be confronted with severe capacitive coupling with other traces on the PCB, thus increasing the capacitive loading. In order to reduce the RC loading, one or more connectors may be implemented on the signal path. However, the connectors may also result in discontinuity of impedance and thus deteriorate the problem of signal reflection. The abovementioned problems of termination and loading limit the frequency of clock signals that could be forwarded through the trace. Therefore, in the architecture of the display control system 10, only a low speed clock signal SCLK may be sent to each driver circuit DC_1-DC_N, and the driver circuits DC_1-DC_N may utilize a phase-locked loop (PLL) to convert the low speed clock signal SCLK into a high speed clock to be used for display control.

Figure 3:
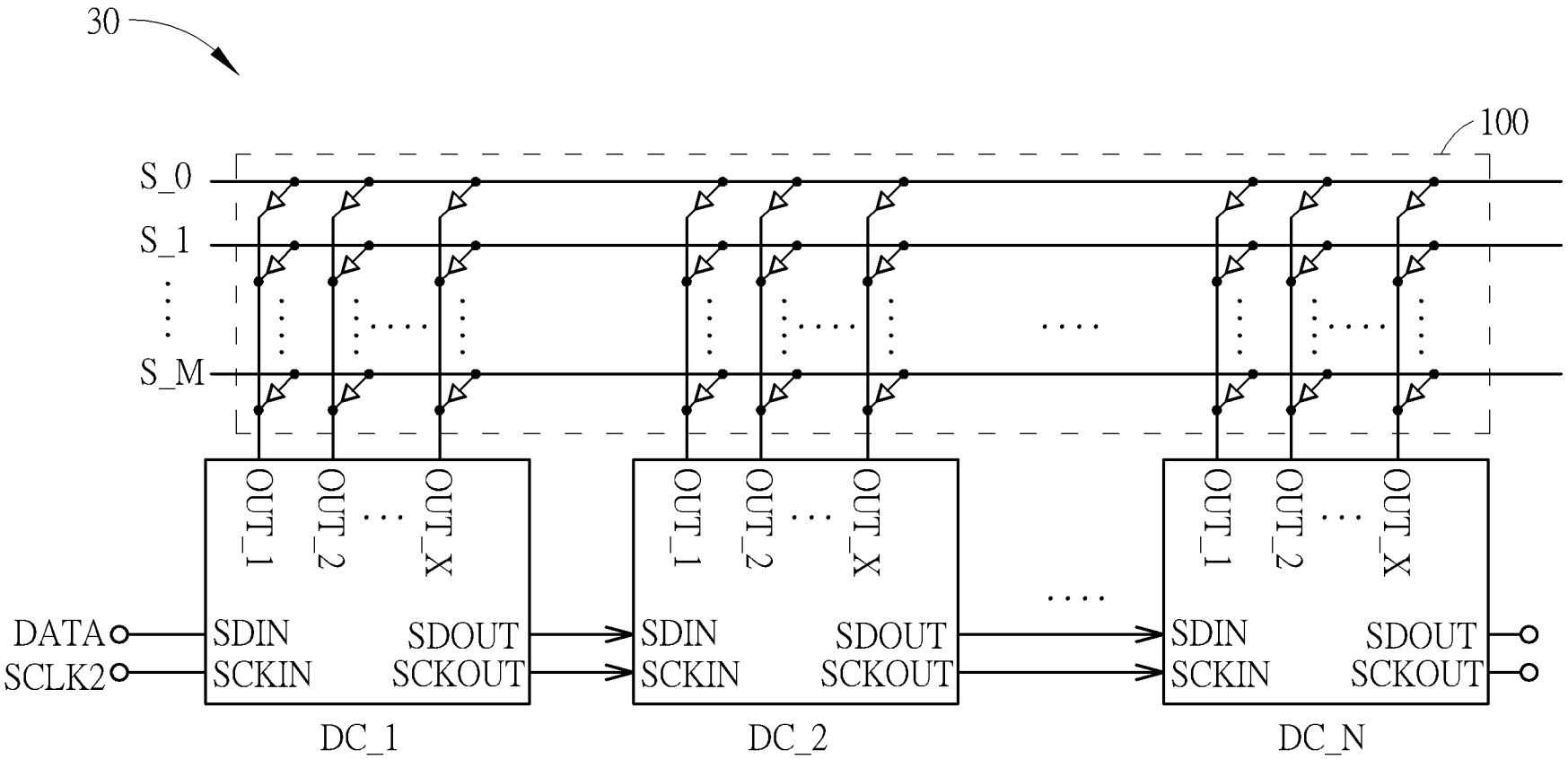
FIG. 3 is a schematic diagram of a display control system according to an embodiment of the present invention.

As mentioned above, a global high speed clock may be applied to avoid the usage of PLL. In order to make the transmission of high speed clock feasible, a novel architecture of display control system is provided. Please refer to FIG. 3, which is a schematic diagram of a display control system 30 according to an embodiment of the present invention. As shown in FIG. 3, the structure of the display control system 30 is similar to the structure of the display control system 10, so signals and elements having similar functions are denoted by the same symbols. The difference between the display control system 30 and the display control system 10 is that, each driver circuit DC_1-DC_N includes a clock output terminal SCKOUT in addition to the clock input terminal SCKIN. Therefore, the clock wires of the display control system 30 are not implemented as the multi-drop bus structure; instead, the clock signal SCLK2 may be sent to the driver circuit DC_1 in the first stage from a video source or main controller. The driver circuit DC_1 may forward the clock signal SCLK2 to the driver circuit DC_2 in the next stage, the driver circuit DC_2 may forward the clock signal SCLK2 to the driver circuit DC_3 in the next stage, . . . and the driver circuit DC(N−1) may forward the clock signal SCLK2 to the driver circuit DC_N in the final stage. In this manner, the clock signal SCLK2 may be sent to all of the driver circuits DC_1-DC_N.

The connections of the driver circuits DC_1-DC_N in the display control system 30 allow the transmissions of high speed clock signal. As shown in FIG. 3, each trace for transmitting the clock signal SCLK2 includes only two terminals, and thus the influence of impedance discontinuity may be minimized. In addition, the length of the trace may also be minimized since each trace is only connected between two adjacent driver circuits. In an embodiment, the length of the trace may be 2 or 3 centimeters only, while the length of the trace in the display control system 10 that connects a great number of driver circuits may be at least tens or hundreds of centimeters or even several meters. The reduction of trace length may achieve the reduction of signal loss and capacitor coupling.

Figure 4:
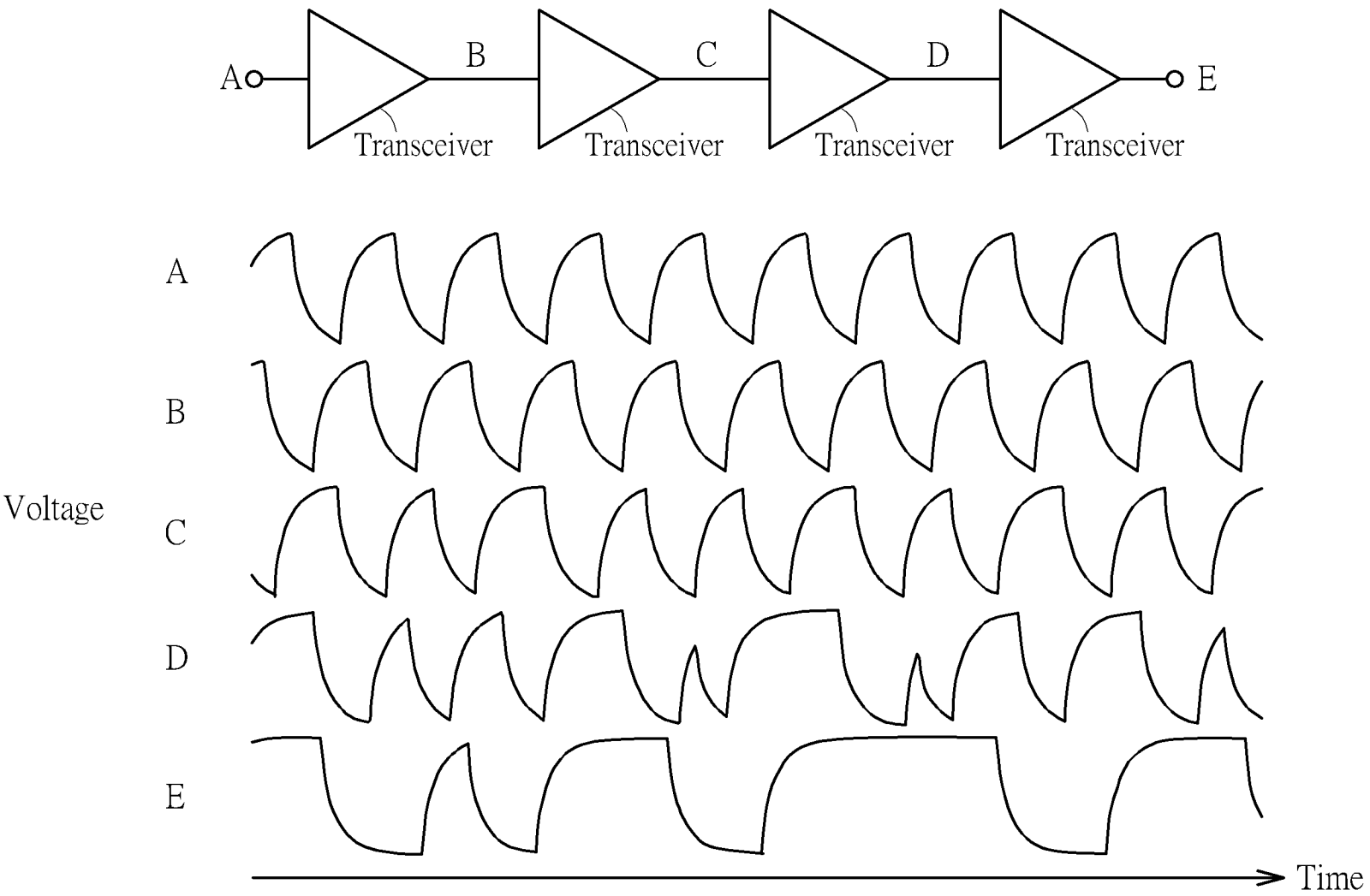
FIG. 4 illustrates the transmission of a clock signal through a series of transceivers.

However, if the driver circuit in each stage forwards the high speed clock signal to the next stage without processing the clock signal, the quality of the clock signal may still become worse after the clock signal passes through a specific number of driver circuits. FIG. 4 illustrates the transmission of a clock signal through a series of transceivers, where each transceiver refers to a receiver and a transmitter included in one driver circuit. As shown in FIG. 4, the clock signal is forwarded from the node A to the nodes B, C, D and E in sequence, and the duty cycle of the clock signal is 50% originally. On the nodes A, B and C, the clock waveform is substantially intact, where the duty cycle appears to have small deviation on the node C. On the node D, it appears that the clock signal in several cycles fails to reach its target voltage and even several clock edges disappear. On the node E, the clock signal is severely distorted and more clock edges disappear. The distortion problem becomes severe when the clock signal has a higher frequency.

In general, the clock signal is usually distorted gradually after passing through multiple stages of circuits. Due to process mismatch of the circuit, the rising time and the falling time of the clock signal may be inconsistent, resulting in the zero crossing distortion and also causing an offset of the duty cycle. This offset may be accumulated in each stage, and eventually the clock edges in several cycles disappear, as the waveform on the node E shown in FIG. 4. This limits the frequency of the clock signal since the high speed clock signal may be more susceptible to the influence of mismatch.

In an embodiment, the driver circuit may include a duty cycle correction (DCC) circuit, which may adjust the duty cycle of the clock signal to be 50%. That is, the duty cycle may be corrected in each stage during the transmission of the clock signal, and thus the signal transmission capability of the driver circuit may be increased, and the signal integrity may be improved. In other words, the DCC circuit allows the display control system to operate in a faster speed, where the display control system may include more numbers of driver circuits, and thus the display control system is capable of processing more display data.

Figure 5:
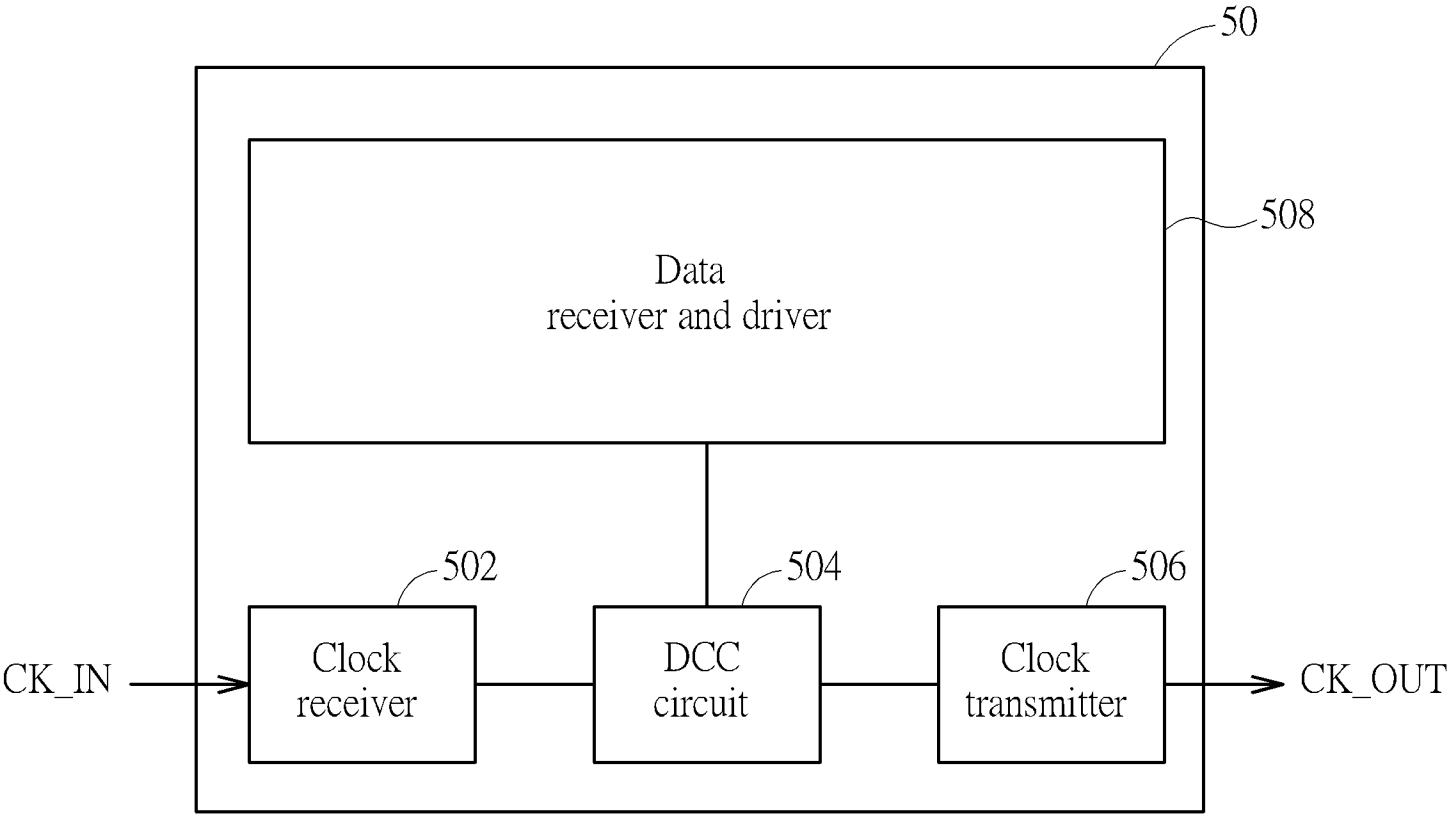
FIG. 5 is a schematic diagram of a driver circuit according to an embodiment of the present invention.

Please refer to FIG. 5, which is a schematic diagram of a driver circuit 50 according to an embodiment of the present invention. As shown in FIG. 5, the driver circuit 50 includes a clock receiver 502, a DCC circuit 504, a clock transmitter 506 and a data receiver and driver 508. The clock receiver 502 may receive an input clock signal CK_IN from a previous stage, which may be the main controller or another driver circuit. The DCC circuit 504, coupled to the clock receiver 502, may adjust the duty cycle of the input clock signal CK_IN to generate an output clock signal CK_OUT. In an embodiment, the DCC circuit 504 may correct the duty cycle to be 50%. The clock transmitter 506, coupled to the DCC circuit 504, may transmit the output clock signal CK_OUT to the driver circuit in the next stage. In addition, the output clock signal CK_OUT after duty cycle correction may also be used for the operations of the data receiver and driver 508. The data receiver and driver 508 is configured to receive and process the display data and correspondingly output the driving voltages corresponding to the display data to the display panel. The data receiver and driver 508 may include a data receiver, a latch, a digital-to-analog converter (DAC), an output buffer, and/or any other necessary circuit module. The detailed implementations and operations of the data receiver and driver 508 are well known by those skilled in the art, and will not be narrated herein.

Therefore, the circuit structure of the driver circuit 50 including the DCC circuit 504 may be implemented as any of the driver circuits DC_1-DC_N in the display control system 30, to improve the integrity of clock signal and facilitate the clock transmission. This allows the usage of a greater number of driver circuits and/or the transmission of clock signal in a higher frequency. In addition, the usage of PLL can be avoided, which leads to a significant reduction of circuit costs and areas of the driver circuits.

In an embodiment, the DCC circuit may be included in each of the driver circuits DC_1-DC_N, so that the duty cycle may be corrected to 50% in each stage, and the clock signal may be recovered to achieve a more ideal waveform in each stage. Alternatively, the DCC circuit may be selectively included in several of the driver circuits DC_1-DC_N. For example, the DCC circuit may be implemented in one of every two or three driver circuits, so that the duty cycle may be corrected after every two or three stages of transmissions. As long as a driver circuit of the display control system has a DCC circuit configured to correct the duty cycle of the clock signal when the clock signal is transmitted between the driver circuits, the related implementations should belong to the scope of the present invention.

Figure 6:
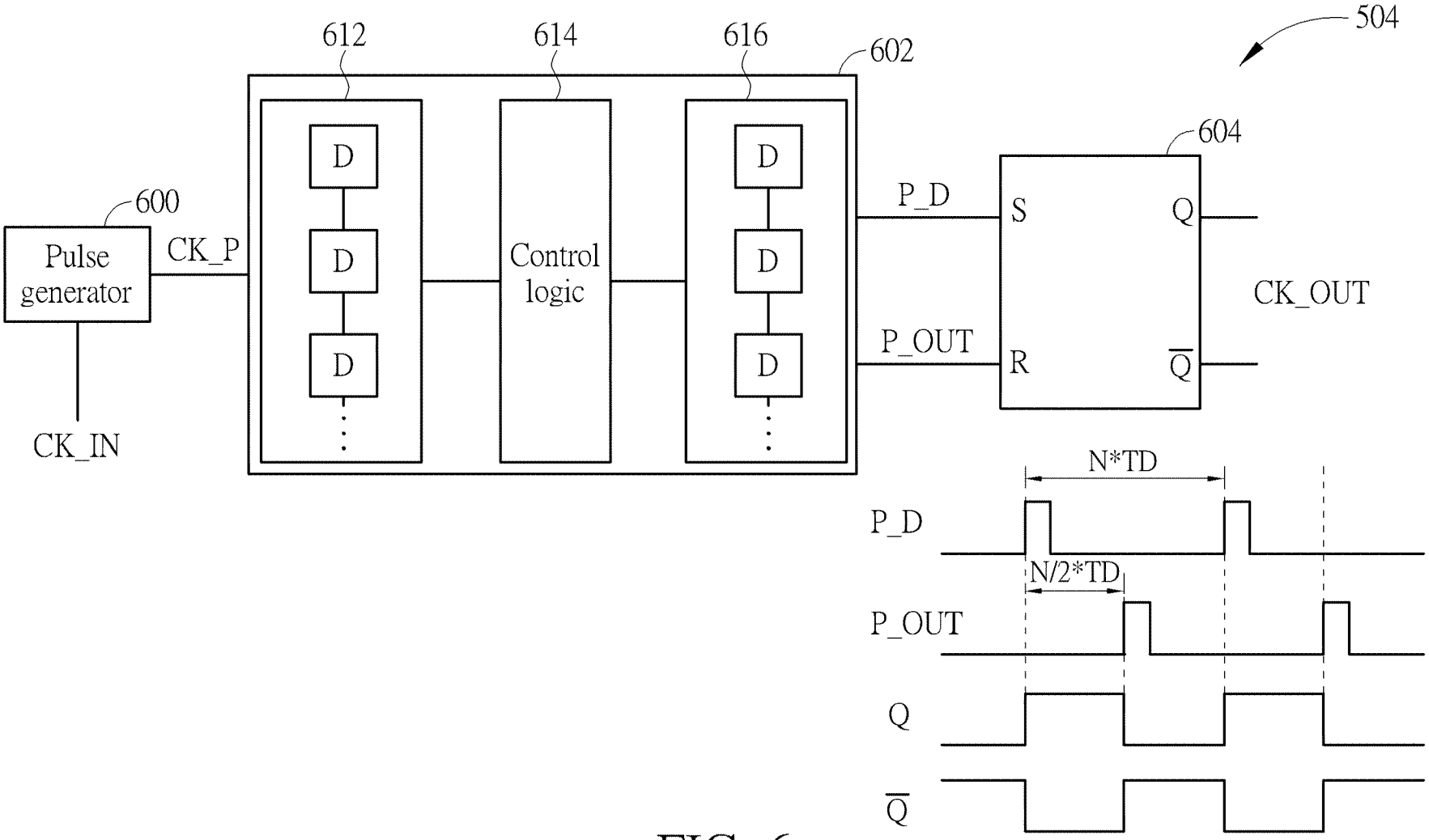
FIG. 6 illustrates a detailed implementation of the DCC circuit.

In the driver circuit of the present invention, the DCC circuit may be implemented in various manners. In an embodiment, the DCC circuit 504 may generate a pulse signal based on the received clock signal, and adjust the duty cycle of the clock signal by detecting the interval length of every two pulses in the pulse signal. Please refer to FIG. 6, which illustrates a detailed implementation of the DCC circuit 504. As shown in FIG. 6, the DCC circuit 504 includes a pulse generator 600, a pulse interval detector 602 and an S-R latch 604. The pulse generator 600 may receive an input clock signal CK_IN and generate a pulse signal CK_P according to the input clock signal CK_IN. The pulse interval detector 602 may receive the pulse signal CK_P from the pulse generator 600, and detect the interval length of two adjacent pulses in the pulse signal CK_P. The S-R latch 604 thereby generates an output clock signal CK_OUT according to the detection result of the pulse interval detector 602.

Figure 7:
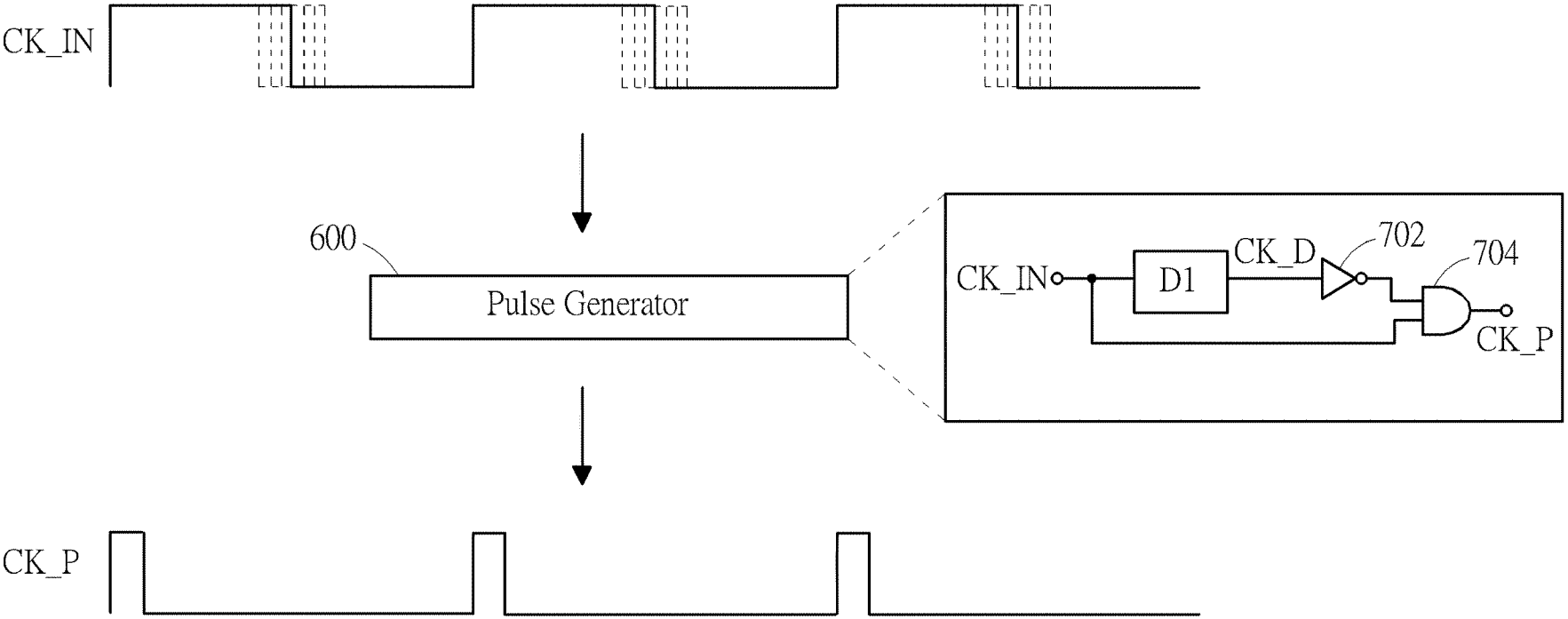
FIG. 7 illustrates a detailed implementation of the pulse generator.

FIG. 7 illustrates a detailed implementation of the pulse generator 600. As shown in FIG. 7, the pulse generator 600 includes a delay cell D1, an inverter 702 and an AND gate 704. The delay cell D1 may receive the input clock signal CK_IN, and generate a delay on the input clock signal CK_IN to generate a delay signal CK_D. The inverter 702 is coupled to the delay cell D1, and configured to invert the delay signal CK_D. The inverted delay signal CK_D and the input clock signal CK_IN are then received by the AND gate 704; hence, the AND gate 704 may generate and output the pulse signal CK_P having pulses corresponding to the rising edges of the input clock signal CK_IN. Note that the duty cycle of the input clock signal CK_IN has an unpredictable deviation during transmissions between the driver circuits. Therefore, the input clock signal CK_IN should be converted into the pulse signal CK_P that can be processed by the subsequent pulse interval detector 602. It should also be noted that the circuit structure shown in FIG. 7 is one of various possible implementations of the pulse generator 600. Those skilled in the art understand that the pulse generator 600 may be realized in other manner, e.g., through another type of logic gate and/or applying the inverter to invert the input clock signal CK_IN instead of the delay signal CK_D.

Please refer back to FIG. 6. The pulse interval detector 602 may include a first delay circuit 612, a control logic 614 and a second delay circuit 616. Each of the first delay circuit 612 and the second delay circuit 616 may include a plurality of delay cells. Preferably, the delay time of the delay cells is configurable, allowing the delay circuits 612 and 616 to generate appropriate delay values.

Figure 8A:
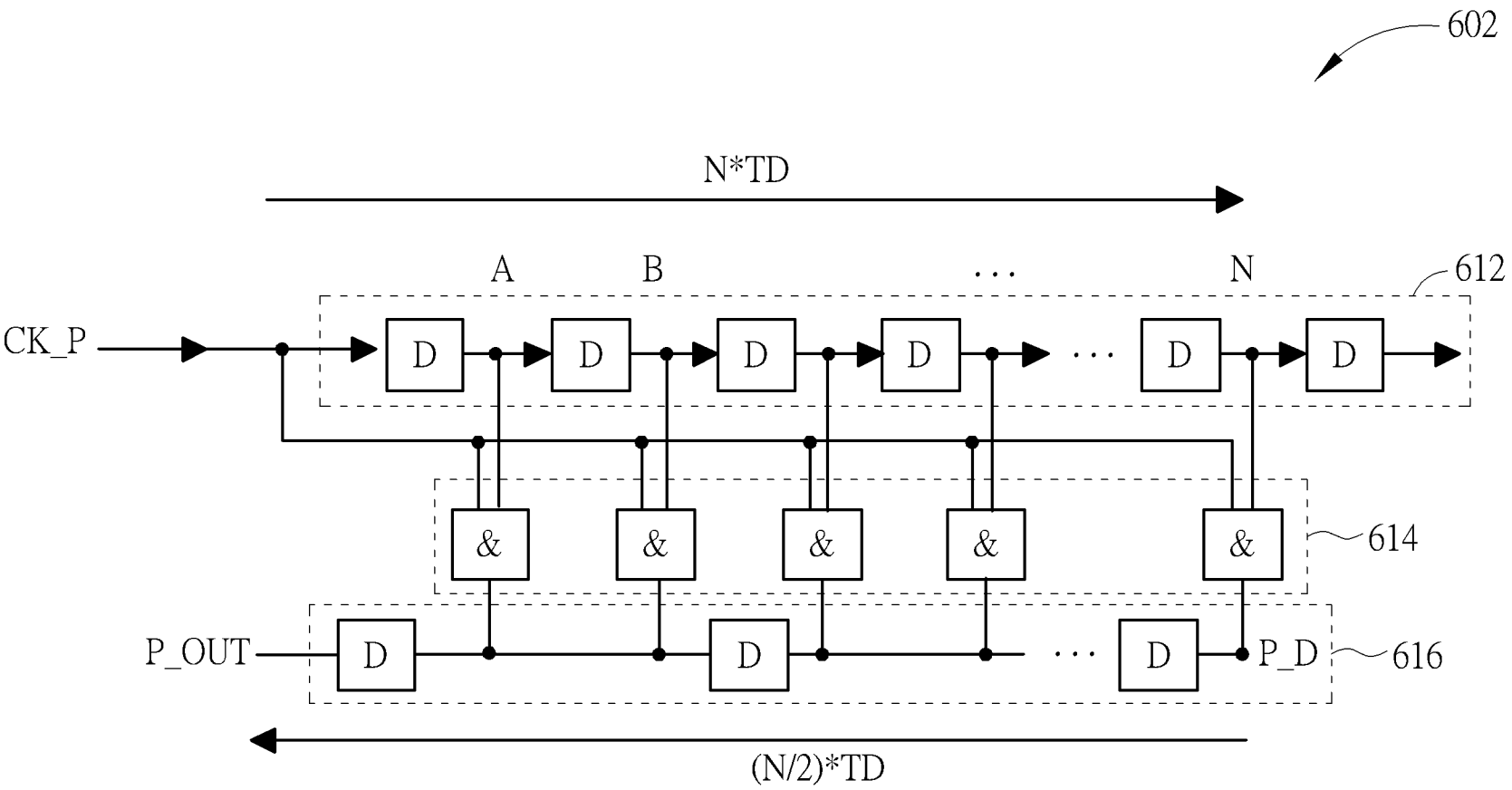
FIG. 8A illustrates a detailed implementation of the pulse interval detector.
Figure 8B:
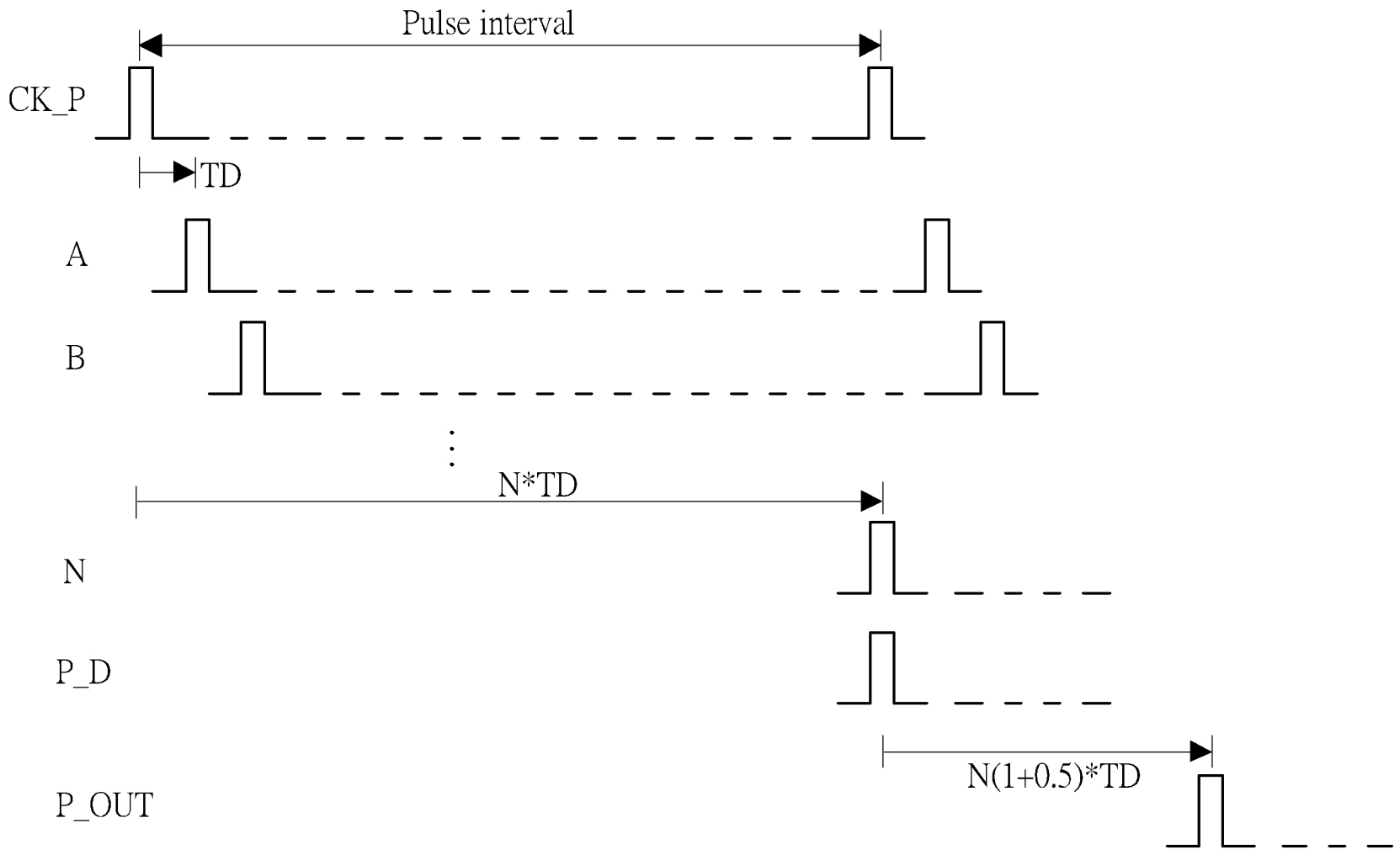
FIG. 8B is a waveform diagram of the delay pulses generated in the pulse interval detector.

FIG. 8A illustrates a detailed implementation of the pulse interval detector 602. As shown in FIG. 8A, the first delay circuit 612, which receives the pulse signal CK_P from the pulse generator 600, includes at least N delay cells, where each delay cell has a delay time equal to TD. Therefore, the pulses in the pulse signal CK_P are delayed through the delay cells to generate delay pulses on the nodes A, B, C . . . N, as the waveforms shown in FIG. 8B. According to the delay pulses, the control logic 614 may determine the number of delay cells in the first delay circuit 612 corresponding to the interval length of two adjacent pulses in the pulse signal CK_P. For example, after N delay cells with a total delay time N×TD in the first delay circuit 612, a pulse in the pulse signal CK_P is delayed to overlap the next pulse. Therefore, the control logic 614 will detect that the interval length of two adjacent pulses in the pulse signal CK_P corresponds to N delay cells. Since the delay time of each delay cell has a given value, the interval length of the pulses may be obtained.

In this embodiment, the control logic 614 includes a plurality of AND gates, wherein each AND gate performs an "AND" operation on the input pulse signal CK_P and one of the delay pulses; hence, a pulse may be generated by the AND gate if the delay pulse overlaps the next pulse in the original pulse signal CK_P. In this way, the delay pulse generated after N delay cells may overlap the next pulse in the original pulse signal CK_P, and thus the corresponding AND gate may output a detection pulse P_D. Based on the detection pulse P_D output through the AND gate corresponding to the node N, the interval length of pulses may be determined to equal N×TD. Note that the structure of the control logic 614 described in this disclosure is one of various implementations of the present invention. In another embodiment, the control logic 614 may be composed of other types of logic gates, as long as the interval length of two adjacent pulses in the pulse signal CK_P may be found through the control logic 614.

In order to generate the output clock signal CK_OUT having a precise duty cycle 50%, the interval length of two adjacent pulses in the pulse signal CK_P should be divided by 2; that is, a period length equal to one half of the interval length of pulses should be obtained. This may be achieved by using the second delay circuit 616. Based on the detection result of the control logic 614, the detection pulse P_D has a delay time N×TD corresponding to N delay cells and the delay time N×TD is equal to the interval length of two adjacent pulses; hence, another delay time (N/2)×TD corresponding to one half of the interval length of pulses may be generated by delaying with N/2 delay cells. In this embodiment, the second delay circuit 616 may generate an output pulse P OUT with a delay time equal to one half of the interval length of two adjacent pulses, i.e., (N/2)×TD. In order to achieve the half delay time, the number of delay cells included in the second delay circuit 616 may be one half of the number of delay cells included in the first delay circuit 612, and every two delay cells in the first delay circuit 612 may correspond to one delay cell in the second delay circuit 616, as shown in FIG. 7.

Please refer back to FIG. 6. The detection pulse P_D and the output pulse P OUT generated in the pulse interval detector 602 are sent to the S-R latch 604, which may generate the output clock signal CK_OUT based on these pulses. Note that the interval between two detection pulses P_D equals a cycle time of the input clock signal CK_IN, and thus the output clock signal CK_OUT having the same frequency may be generated. Also, the interval between the output pulse P OUT and the detection pulse P_D equals (N/2)×TD, which means that the duty cycle of the output clock signal CK_OUT is corrected to 50% precisely.

Figure 9:
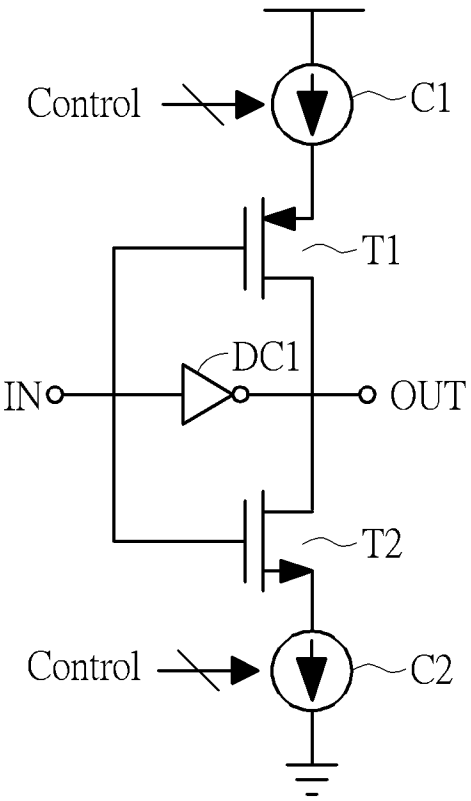
FIG. 9 illustrates an exemplary inverter that may be used to realize a delay cell.

The delay cells in the embodiments of the present invention may be implemented in any manners. For example, any logic gate, such as an AND gate, OR gate, NAND gate, NOR gate, Exclusive-NOR (XNOR) gate, Exclusive-OR (XOR) gate or inverter, may be used to realize the delay function, and the delay cells may be implemented with any of these logic gates or their combinations. FIG. 9 illustrates an exemplary inverter that may be used to realize a delay cell. Note that a delay cell may be implemented with even numbers of inverters connected in series.

As shown in FIG. 9, the inverter includes transistors T1 and T2, current sources C1 and C2, and a driving cell DC1. For the transistors T1 and T2, their drain terminals are coupled together and their gate terminals are coupled together, to realize the inverter structure. The current sources C1 and C2 are controllable current sources coupled to the source terminals of the transistors T1 and T2, respectively, and may receive the same or different control signals to output appropriate current values, in order to adjust the delay value according to the output currents. The driving cell DC1 may provide sufficient driving capability for improving the slew rate of the output signal of the inverter.

Therefore, the delay time of this inverter may be configurable and adjustable based on the control signals for the current sources C1 and C2. In an embodiment, the delay time may be adjusted to an appropriate value according to system requirements. For example, when the DCC circuit 504 is served to process a clock signal having a higher frequency, since the received clock signal has a shorter cycle, it is preferable to configure smaller delay time for each delay cell, in order to obtain the position of the detection pulse more precisely. When the DCC circuit 504 is served to process a clock signal having a lower frequency, since the received clock signal has a longer cycle and the interval between pulses is also longer, it is preferable to configure larger delay time for each delay cell, in order to find the pulse overlapping position under a limited number of delay cells in the delay circuit. The system may detect the clock frequency, and thereby generate appropriate control signals for the delay cell to achieve an appropriate delay time.

Please note that the present invention aims at providing a display control system consisting of a plurality of driver circuits connected in series, between which the transmission of high speed clock signal is allowable with the implementations of DCC circuit in the driver circuits. Those skilled in the art may make modifications and alterations accordingly. For example, in the display control system of the present invention, the clock signal may be transmitted between the driver circuits through any type of high speed interface such as the low voltage differential signaling (LVDS) interface and/or the mini-LVDS interface. In addition to differential transmission, the clock signal may also be transmitted in single-ended form, and the structure of the clock receiver 502 and the clock transmitter 506 of the driver circuits may be configured accordingly.

In addition, the DCC circuit 504 may also be performed in various manners. In an embodiment, in the pulse interval detector 602, the AND gates implemented in the control logic 614 may be replaced by other types of logic gates that are capable of pulse detection. Further, in the DCC circuit 504 as shown in FIG. 6, the S-R latch 604 may be replaced by another type of flip-flop or any other combination of logic gates to achieve an appropriate frequency and the duty cycle 50% in the output clock signal CK_OUT. Also, the DCC circuit 504 may be implemented in other manner or have another circuit structure. As the DCC circuit 504 shown in FIG. 6 is implemented as a digital DCC circuit, in another embodiment, the DCC circuit 504 may also be implemented in analog form.

Figure 10:
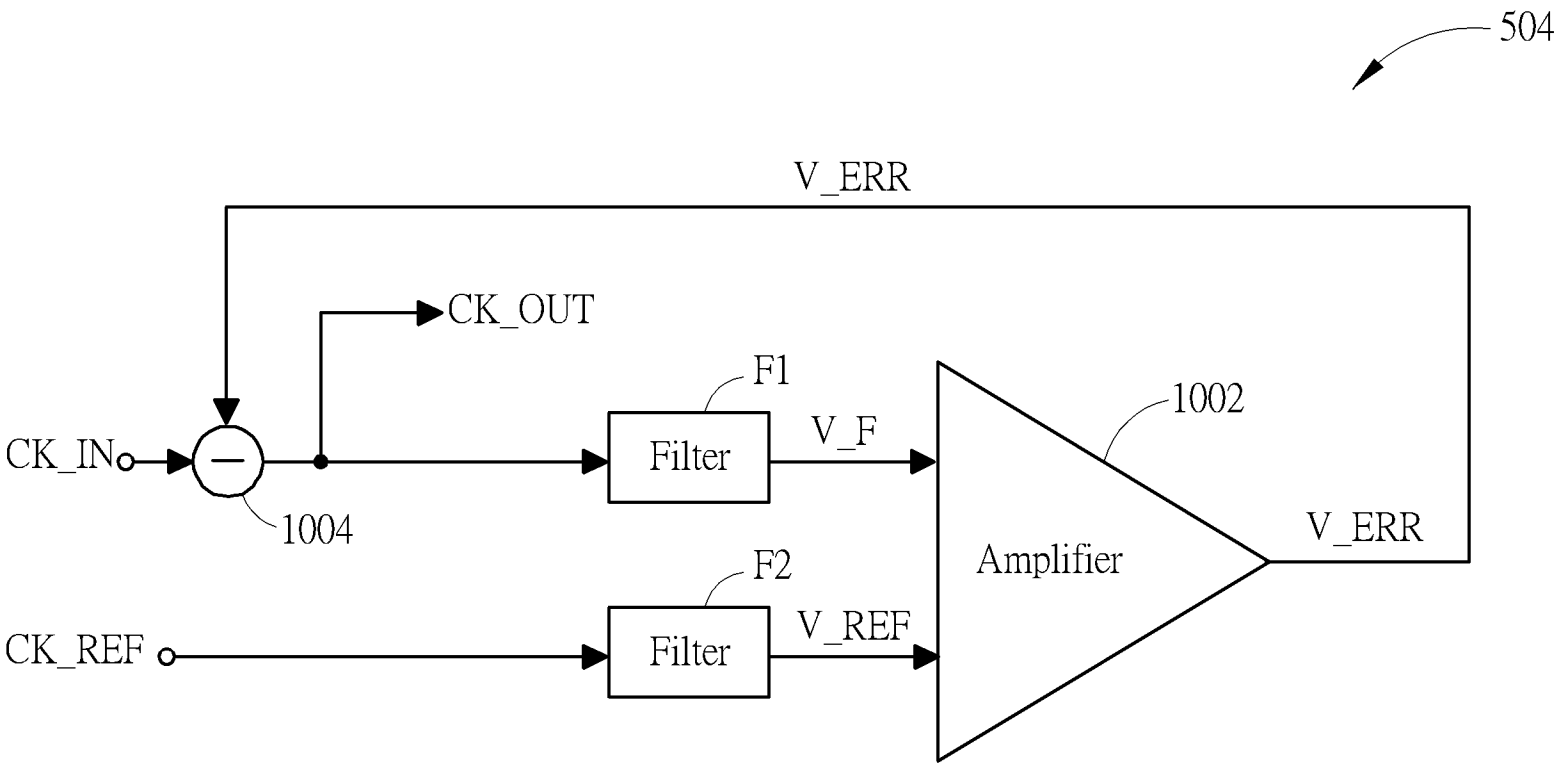
FIGS. 10-12 illustrate other detailed implementations of the DCC circuit.

Please refer to FIG. 10, which illustrates another detailed implementation of the DCC circuit 504, which may receive the input clock signal CK_IN and adjust the duty cycle of the input clock signal CK_IN to generate the output clock signal CK_OUT. As shown in FIG. 10, the DCC circuit 504 includes an amplifier 1002, filters F1 and F2, and an operator 1004. The filter F1 is coupled to a first input terminal of the amplifier 1002, and the filter F2 is coupled to a second input terminal of the amplifier 1002. The operator 1004 is coupled to the filter F1 and also coupled to the output terminal of the amplifier 1002. The filter F1 may receive the input clock signal CK_IN and filter the input clock signal CK_IN to generate a filter signal V_F. The filter F2 may receive a reference clock CK_REF and filter the reference clock CK_REF to generate a reference voltage V REF. The amplifier 1002 thereby generates a feedback signal V ERR according to the filter signal V_F and the reference voltage V REF. The feedback signal V ERR may be sent to the operator 1004 through the negative feedback connection. Therefore, the operator 1004 may generate the output clock signal CK_OUT according to the input clock signal CK_IN and the feedback signal V ERR, e.g., by subtracting the feedback signal V ERR from the input clock signal CK_IN, so as to adjust the duty cycle of the input clock signal CK_IN in the feedback mechanism.

The amplifier 1002 with the negative feedback structure and the filters F1 and F2 may be used to modify the duty cycle of the input clock signal CK_IN to be 50%. If the duty cycle is greater than 50%, the filter signal V_F generated through filtering (i.e., by the filter F1) may continuously increase. If the duty cycle is less than 50%, the filter signal V_F generated through filtering may continuously decrease. The feedback mechanism of the amplifier 1002 allows the duty cycle of the output clock signal CK_OUT to reach 50%, where a constant filter signal V_F is achieved.

In this embodiment, the reference clock CK_REF may be a clock signal having a precise duty cycle 50%, and thus the reference clock CK_REF may be converted into a precise reference voltage V REF through filtering (i.e., by the filter F2). In another embodiment, the reference voltage V REF may be directly provided from an external voltage source or voltage generator. In such a situation, the filter F2 may be omitted. Alternatively, the reference voltage V REF may still be filtered by the filter F2, in order to improve its stability.

Figure 11:
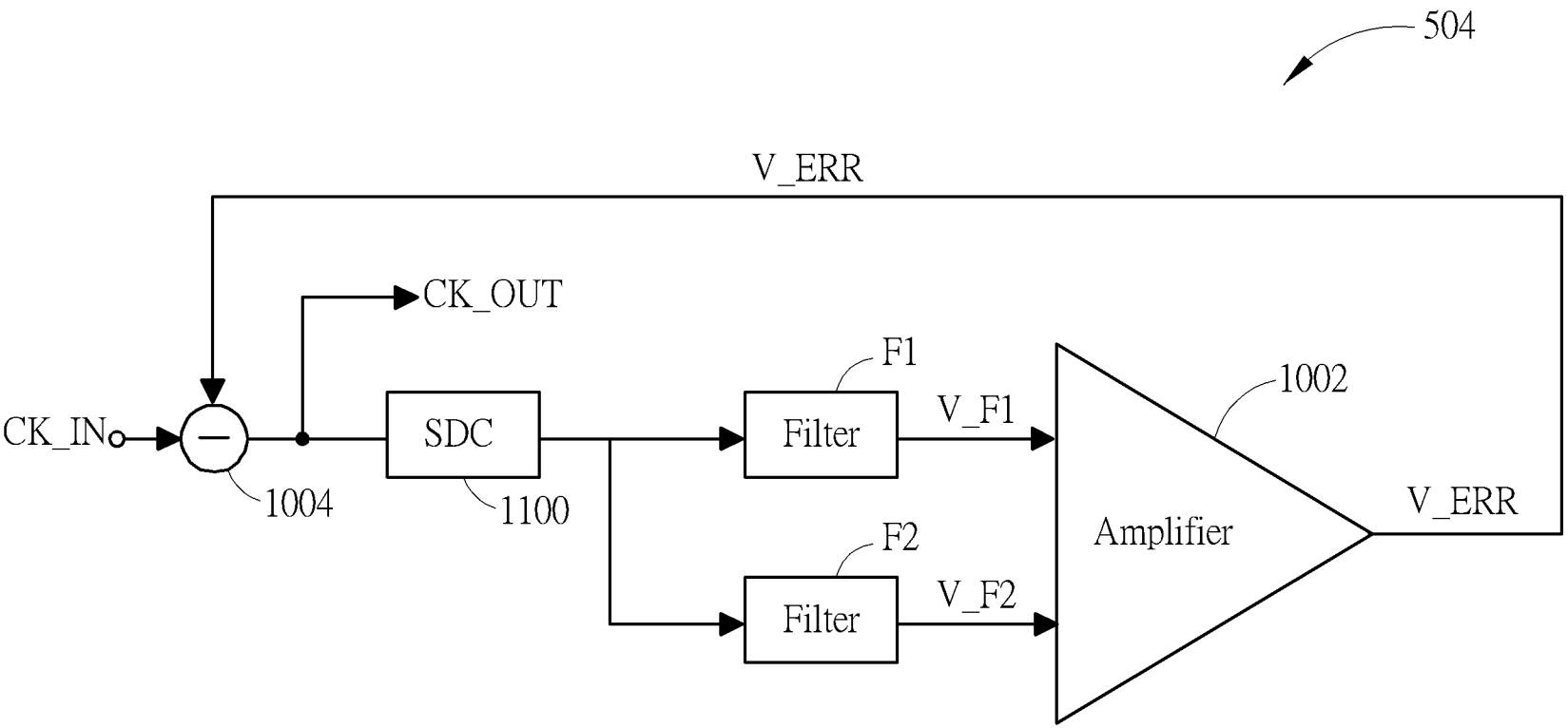

Please refer to FIG. 11, which illustrates a further detailed implementation of the DCC circuit 504. The circuit structure of the DCC circuit 504 shown in FIG. 11 is similar to that shown in FIG. 10, so signals and elements having similar functions are denoted by the same symbols. Their difference is that the DCC circuit 504 shown in FIG. 11 applies a single-to-differential converter (SDC) 1100 to convert the input clock signal CK_IN into differential signals, instead of using an external reference clock or reference voltage. In this way, the differential signals may be filtered through the filters F1 and F2, respectively, to generate filter signals V_F1 and V_F2, which are sent to the two input terminals of the amplifier 1002. The amplifier 1002 thereby generates the feedback signal V ERR according to the filter signals V_F1 and V_F2. With the negative feedback mechanism of the amplifier 1002, the duty cycle of the output clock signal CK_OUT will reach 50% after adjustment or correction. That is, the feedback system will become stable when the duty cycles of the differential signals are equal and thus the voltages of the filter signals V_F1 and V_F2 are equal.

Figure 12:
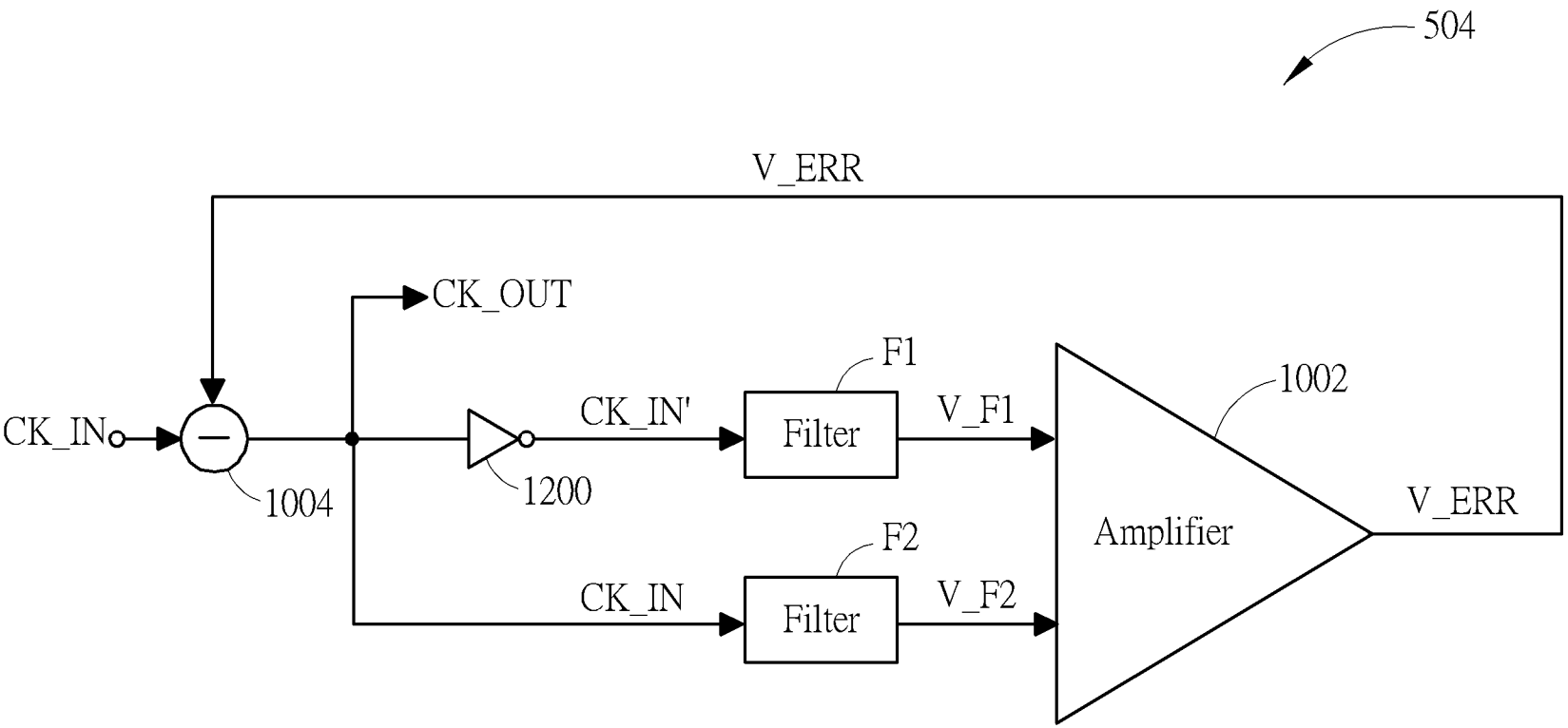

In another embodiment, the SDC 1100 may be replaced by an inverter 1200, as shown in FIG. 12, where similar duty cycle correction effects may be achieved. The inverter 1200 may generate an inverse clock signal CK_IN' based on the received input clock signal CK_IN. The inverse clock signal CK_IN' and the input clock signal CK_IN are filtered through the filters F1 and F2, respectively, and then sent to the input terminals of the amplifier 1002. Other detailed implementations and operations of the DCC circuit 504 shown in FIG. 12 are similar to those described above, and will not be repeated herein.

According to the implementations of the negative feedback structure, the duty cycle of the input clock signal CK_IN may be corrected to 50% to be outputted as the output clock signal CK_OUT with reference to a reference voltage. FIG. 10 shows that the reference voltage V REF may be generated by filtering a received reference clock, or may be received from an external circuit. In addition, FIG. 11 shows that the reference voltage may be generated through the SDC 1100, and FIG. 12 shows that the reference voltage may be generated through the inverter 1200. In the embodiments of FIG. 11 and FIG. 12, the usage of external reference clock or reference voltage may be omitted.

Figure 13:
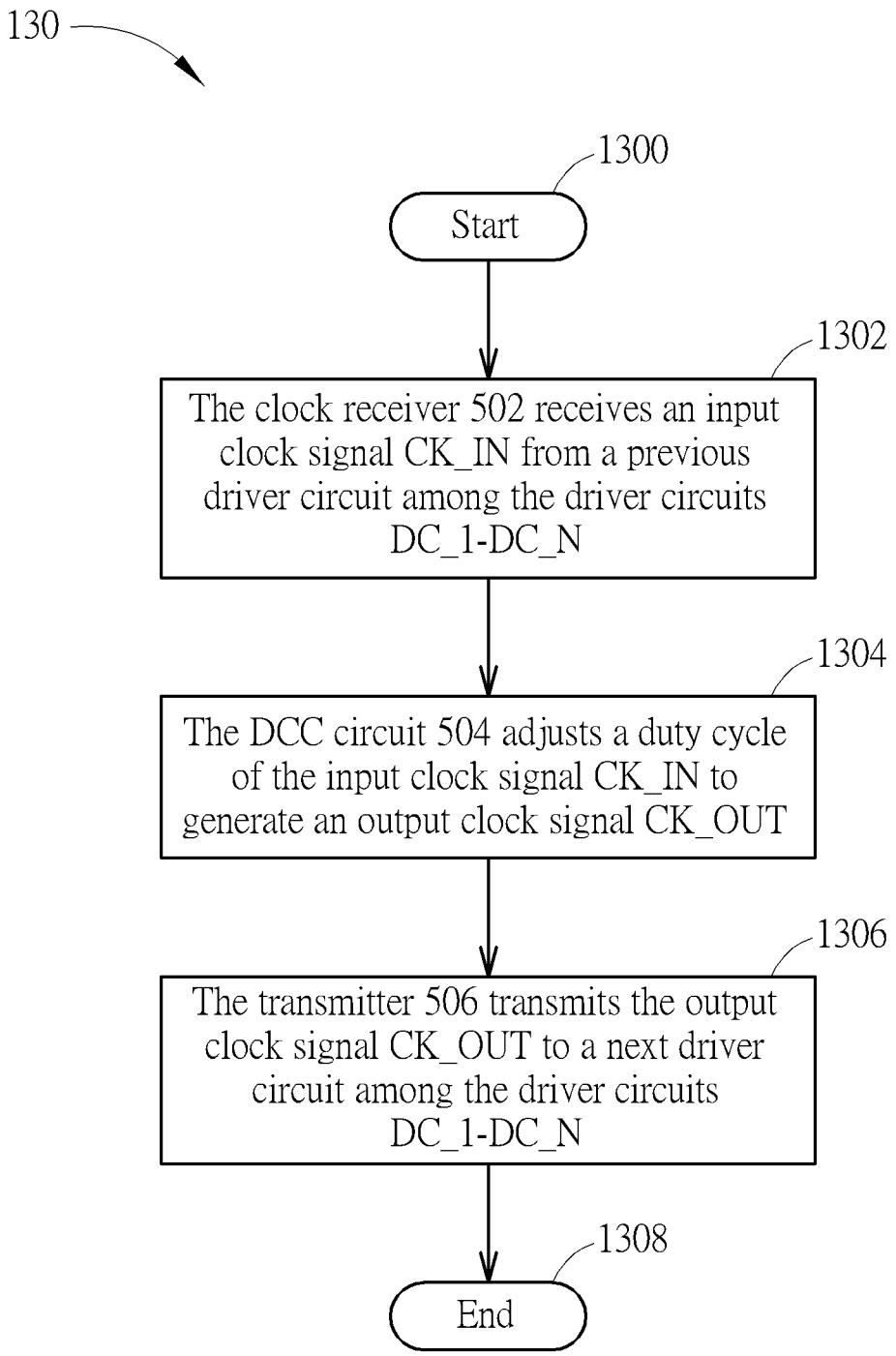
FIG. 13 is a flowchart of a process according to an embodiment of the present invention.

The abovementioned implementations and operations of the display control circuit 30 may be summarized into a process 130, as shown in FIG. 13. The process 130 may be implemented in the driver circuit 504, which may be any of the driver circuits DC_1-DC_N included in the display control circuit 30. As shown in FIG. 13, the process 130 includes the following steps:

Step 1300: Start.

Step 1302: The clock receiver 502 receives an input clock signal CK_IN from a previous driver circuit among the driver circuits DC_1-DC_N.

Step 1304: The DCC circuit 504 adjusts a duty cycle of the input clock signal CK_IN to generate an output clock signal CK_OUT.

Step 1306: The transmitter 506 transmits the output clock signal CK_OUT to a next driver circuit among the driver circuits DC_1-DC_N.

Step 1308: End.

The detailed operations and alterations of the process 130 are illustrated in the above paragraphs, and will not be narrated herein.

To sum up, the embodiments of the present invention provide a display control system and a method of clock transmission between the driver circuits of the display control system. The driver circuits may be connected in series, where the clock signal is transmitted to each driver circuit stage by stage. The driver circuit may include a DCC circuit, which is configured to correct the duty cycle of the received clock signal. Therefore, a high speed clock signal may be transmitted through the driver circuits connected in series, and the distortion of the clock signal may be improved with the duty cycle correction. In an embodiment, the DCC circuit may include a pulse generator configured to convert the clock signal into a pulse signal, and include a pulse interval detector having a delay circuit to detect the interval of two pulses in the pulse signal, to find out the pulse interval and thereby control the pulse width to reach the duty cycle 50%. In another embodiment, the DCC circuit may use the feedback mechanism of an amplifier to correct the duty cycle of the clock signal to be 50%, to generate the output clock signal. With the implementation of the DCC circuit, the usage of a great number of driver circuits and/or the transmission of clock signal in a higher frequency may be feasible. In addition, the high speed clock may be transmitted between the driver circuits, and the driver circuits will not need an additional PLL to perform frequency multiplication; this significantly reduces the circuit costs and areas of the driver circuits.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display control system, comprising:

a plurality of driver circuits connected in series, among which a driver circuit comprises:

a receiver, configured to receive a first signal from a previous driver circuit among the plurality of driver circuits;

a duty cycle correction circuit, coupled to the receiver, configured to adjust a duty cycle of the first signal to generate a second signal; and a transmitter, coupled to the duty cycle correction circuit, configured to transmit the second signal to a next driver circuit among the plurality of driver circuits.

2. The display control system of claim 1, wherein each of the first signal and the second signal is a clock signal.

3. The display control system of claim 1, wherein the plurality of driver circuits are configured to drive a light-emitting diode (LED) display panel.

4. The display control system of claim 1, wherein the duty cycle correction circuit comprises:

a pulse generator, configured to generate a pulse signal according to the first signal;

a pulse interval detector, coupled to the pulse generator, configured to detect an interval length of two adjacent pulses in the pulse signal; and an S-R latch, coupled to the pulse interval detector, configured to generate the second signal according to a detection result of the pulse interval detector.

5. The display control system of claim 4, wherein the pulse generator comprises:

a delay cell, configured to generate a delay signal according to the first signal;

an inverter, coupled to the delay cell, configured to invert the delay signal or the first signal; and an AND gate, coupled to the inverter, configured to generate the pulse signal according to the delay signal and the first signal.

6. The display control system of claim 4, wherein the pulse interval detector comprises:

a first delay circuit, configured to generate a plurality of delay pulses according to the pulse signal;

a control logic, coupled to the first delay circuit, configured to determine a number of delay cells in the first delay circuit corresponding to the interval length of two adjacent pulses in the pulse signal according to the plurality of delay pulses; and a second delay circuit, coupled to the control logic, configured to generate an output pulse with a delay time corresponding to one half of the interval length.

7. The display control system of claim 6, wherein a number of delay cells included in the second delay circuit is one half of the number of delay cells included in the first delay circuit.

8. The display control system of claim 6, wherein a delay time of the delay cells is adjustable.

9. The display control system of claim 1, wherein the duty cycle correction circuit comprises:

a first filter;

an operator, coupled to the first filter;

an amplifier, comprising:

a first input terminal, coupled to the first filter;

a second input terminal; and an output terminal, coupled to the operator.

10. The display control system of claim 9, wherein the first filter is configured to filter the pulse signal to generate a filter signal, and the amplifier is configured to generate a feedback signal according to the filter signal and a reference voltage.

11. The display control system of claim 10, wherein the operator is configured to generate the second signal according to the pulse signal and the feedback signal.

12. The display control system of claim 9, wherein the duty cycle correction circuit further comprises:

a second filter, coupled to the second input terminal of the amplifier.

13. The display control system of claim 12, wherein the second filter is configured to filter a reference clock to generate a reference voltage for the amplifier.

14. The display control system of claim 9, wherein the duty cycle correction circuit further comprises:

a second filter, coupled to the second input terminal of the amplifier; and a single-to-differential converter, coupled between the operator, the first filter and the second filter.

15. The display control system of claim 14, wherein the single-to-differential converter is configured to convert the pulse signal into a first differential signal and a second differential signal, the first filter is configured to filter the first differential signal to generate a first filter signal, the second filter is configured to filter the second differential signal to generate a second filter signal, and the amplifier is configured to generate a feedback signal according to the first filter signal and the second filter signal.

16. The display control system of claim 9, wherein the duty cycle correction circuit further comprises:

a second filter, coupled to the second input terminal of the amplifier; and an inverter, coupled between the operator and the first filter.

17. The display control system of claim 16, wherein the inverter is configured to invert the pulse signal to generate an inverse pulse signal, the first filter is configured to filter the inverse pulse signal to generate a first filter signal, the second filter is configured to filter the pulse signal to generate a second filter signal, and the amplifier is configured to generate a feedback signal according to the first filter signal and the second filter signal.

18. The display control system of claim 1, wherein each of the first signal and the second signal is transmitted through at least one of a low voltage differential signaling (LVDS) interface and a mini-LVDS interface.

19. A method of signal transmission for a driver circuit among a plurality of driver circuits connected in series, the method comprising:

receiving a first signal from a previous driver circuit among the plurality of driver circuits;

adjusting a duty cycle of the first signal to generate a second signal; and transmitting the second signal to a next driver circuit among the plurality of driver circuits.

20. The method of claim 19, wherein each of the first signal and the second signal is a clock signal.

21. The method of claim 19, wherein the plurality of driver circuits are configured to drive a light-emitting diode (LED) display panel.

22. The method of claim 19, wherein each of the first signal and the second signal is transmitted through at least one of a low voltage differential signaling (LVDS) interface and a mini-LVDS interface.

* * * * *